US005475397A

United States Patent [19]

Saidi

[11] Patent Number: 5,475,397

[45] Date of Patent: Dec. 12, 1995

[54] METHOD AND APPARATUS FOR REDUCING DISCONTINUITIES IN AN ACTIVE ADDRESSING DISPLAY SYSTEM

[75] Inventor: Ali Saidi, Boynton Beach, Fla.

[73] Assignee: Motorola, Inc., Schaumburg, Ill.

[21] Appl. No.: 89,199

[22] Filed: Jul. 12, 1993

[51] Int. Cl.[6] ..... G09G 3/36

[52] U.S. Cl. ..... 345/95; 345/100; 345/208

[58] Field of Search ..... 345/84, 90, 94, 345/95, 97, 98, 99, 100, 103, 197, 210; 340/825.44; 359/54, 55

[56] References Cited

U.S. PATENT DOCUMENTS

| | | | |
|---|---|---|---|
| 4,651,148 | 3/1987 | Takeda et al. | 345/94 |
| 4,771,279 | 9/1988 | Hannah | 345/197 |
| 4,778,260 | 10/1988 | Okada et al. | 345/103 |
| 4,952,036 | 8/1990 | Gulick et al. . | |
| 5,060,036 | 10/1991 | Choi . | |
| 5,065,423 | 11/1991 | Gaskill | 340/825.44 |
| 5,136,282 | 8/1992 | Inaba et al. | 345/103 |
| 5,172,105 | 12/1992 | Katakura et al. | 345/103 |
| 5,262,881 | 11/1993 | Kuwata et al. | 345/210 |

FOREIGN PATENT DOCUMENTS 0507061 10/1992 European Pat. Off. .

OTHER PUBLICATIONS

Terry Scheffer and Jurgen Nehring, "Supertwisted Nematic (STN) LCDs," May 17, 1992, paper submitted to 1992 SID International Symposium, Boston, Massachusetts.

Related European Patent Application o. 92102353.7, filed Feb. 12, 1992 by Scheffer et al.

Scheffer et al., Addressing Method for High–Contrast Video Rate STN Displays, SID 92 Digest, May, 1992, pp. 228–231.

Ruckmongathan, T. N., "A Generalized Addressing Technique For RMS Responding Matrix LCDs", 1988 International Display Conference, pp. 80–85.

*Primary Examiner*—Richard Hjerpe
*Assistant Examiner*—Steven J. Saras
*Attorney, Agent, or Firm*—Kelly A. Gardner; Daniel K. Nichols; John H. Moore

[57] ABSTRACT

An electronic device (605) for presenting data comprises a display (600) having at least first and second segments (705, 710) comprising, respectively, first and second pluralities of rows, wherein at least one overlapping row (637) is included in both the first and second segments (705, 710). A first driving circuit (650) coupled to the display (600) drives, during a first set of time periods, the first plurality of rows with a first set of orthonormal functions, including a first at least one modified orthonormal function for driving the at least one overlapping row (637), and a second driving circuit (652) coupled to the display (600) drives, during a second set of time periods, the second plurality of rows with a second set of orthonormal functions, including a second at least one modified orthonormal function for driving the at least one overlapping row (637).

17 Claims, 10 Drawing Sheets

$$\begin{bmatrix} 1 & 1 & 1 & 1 & 1 & 1 & 1 & 1 \\ 1 & 1 & 1 & 1 & -1 & -1 & -1 & -1 \\ 1 & 1 & -1 & -1 & -1 & -1 & 1 & 1 \\ 1 & 1 & -1 & -1 & 1 & 1 & -1 & -1 \\ 1 & -1 & -1 & 1 & 1 & -1 & -1 & 1 \\ 1 & -1 & -1 & 1 & -1 & 1 & 1 & -1 \\ 1 & -1 & 1 & -1 & -1 & 1 & -1 & 1 \\ 1 & -1 & 1 & -1 & 1 & -1 & 1 & -1 \end{bmatrix}$$
300 *FIG. 3*
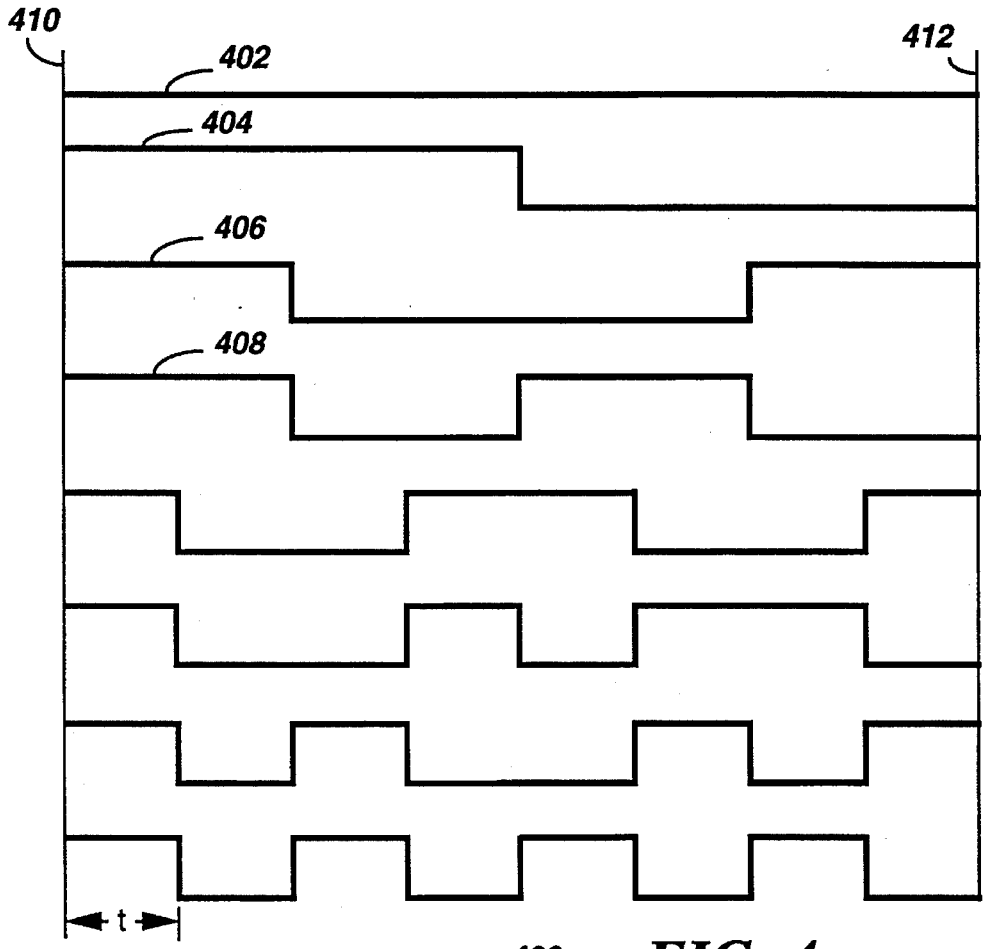
400 *FIG. 4*

METHOD AND APPARATUS FOR REDUCING DISCONTINUITIES IN AN ACTIVE ADDRESSING DISPLAY SYSTEM

FIELD OF THE INVENTION

This invention relates in general to displays for displaying image data, and more specifically to a method and apparatus for reducing discontinuities in active-addressed displays.

BACKGROUND OF THE INVENTION

An example of a direct multiplexed, rms (root means square) responding electronic display is the well-known liquid crystal display (LCD). In such a display, a nematic liquid crystal material is positioned between two parallel glass plates having electrodes applied to each surface in contact with the liquid crystal material. The electrodes typically are arranged in vertical columns on one plate and horizontal rows on the other plate for driving a picture element (pixel) wherever a column and row electrode overlap.

In rms-responding displays, the optical state of a pixel is substantially responsive to the square of the voltage applied to the pixel, i.e., the difference in the voltages applied to the electrodes on the opposite sides of the pixel. LCDs have an inherent time constant that characterizes the time required for the optical state of a pixel to return to an equilibrium state after the optical state has been modified by changing the voltage applied to the pixel. Recent technological advances have produced LCDs with time constants (approximately 16.7 milliseconds) approaching the frame period used in many video displays. Such a short time constant allows the LCD to respond quickly and is especially advantageous for depicting motion without noticeable smearing or flickering of the displayed image.

Conventional direct multiplexed addressing methods for LCDs encounter a problem when the display time constant approaches the frame period. The problem occurs because conventional direct multiplexed addressing methods subject each pixel to a short duration "selection" pulse once per frame. The voltage level of the selection pulse is typically 7–13 times higher than the rms voltages averaged over the frame period. The optical state of a pixel in an LCD having a short time constant tends to return towards an equilibrium state between selection pulses, resulting in lowered image contrast, because the human eye integrates the resultant brightness transients at a perceived intermediate level. In addition, the high level of the selection pulse can cause alignment instabilities in some types of LCDs.

To overcome the above-described problems, an "active addressing" method for driving rms responding electronic displays has been developed. The active addressing method continuously drives the row electrodes with signals comprising a train of periodic pulses having a common period T corresponding to the frame period. The row signals are independent of the image to be displayed and preferably are orthogonal and normalized, i.e., orthonormal. The term "orthogonal" denotes that, if the amplitude of a signal applied to one of the rows is multiplied by the amplitude of a signal applied to another one of the rows, the integral of this product over the frame period is zero. The term "normalized" denotes that all the row signals have the same rms voltage integrated over the frame period T.

During each frame period a plurality of signals for the column electrodes are calculated and generated from the collective state of the pixels in each of the columns. The column voltage at any time t during the frame period is proportional to the sum obtained by considering each pixel in the column, multiplying a "pixel value" representing the optical state (either −1 for fully "on", +1 for fully "off", or values between −1 and +1 for proportionally corresponding gray shades) of the pixel by the value of that pixel's row signal at time t, and adding the products obtained thereby to the sum. In effect, the column voltages can be derived by transforming each column of a matrix of incoming image data by the orthonormal signals utilized for driving the rows of the display.

If driven in the active addressing manner described above, it can be shown mathematically that there is applied to each pixel of the display an rms voltage averaged over the frame period, and that the rms voltage is proportional to the pixel value for the frame. The advantage of active addressing is that it restores high contrast to the displayed image because, instead of applying a single, high level selection pulse to each pixel during the frame period, active addressing applies a plurality of much lower level (2–5 times the rms voltage) selection pulses spread throughout the frame period. In addition, the much lower level of the selection pulses substantially reduces the probability of alignment instabilities. As a result, utilizing an active addressing method, rms responding electronic displays, such as LCDs utilized in portable radio devices, can display image data at video speeds without smearing or flickering. Additionally, LCDs driven with an active addressing method can display image data having multiple shades without the contrast problems present in LCDs driven with conventional multiplexed addressing methods.

A drawback to utilizing active addressing results from the large number of calculations required to generate column and row signals for driving an rms-responding display. For example, a display having 480 rows and 640 columns requires approximately 230, 400 (# rows$^2$) operations simply for generation of the column values for a single column during one frame period. While it is, of course, possible to perform calculations at this rate, such complex, rapidly performed calculations necessitate a large amount of power consumption and a large amount of memory. Therefore, a method referred to as "reduced line addressing" has been developed.

In reduced line addressing, the rows of a display are evenly divided and addressed separately. If, for instance, a display having 480 rows and 640 columns is utilized to display image data, the display could be divided into eight groups of sixty (60) rows, which are each addressed for ⅛ of the frame time, thus requiring only 60 (rather than 480) orthonormal signals for driving the rows. In operation, columns of an orthonormal matrix, which is representative of the orthonormal signals, are applied to rows of the different segments during different time periods. During the different time periods, the columns of the display are driven with rows of a "transformed image data matrix", which is representative of the image data which has been previously transformed, as described above, utilizing the orthonormal signals. In reduced line addressing, however, the transformed image data matrix can be transformed using the smaller set of orthonormal signals, i.e., using 60 orthonormal signals rather than 480 orthonormal signals. More specifically, the image data matrix is divided into segments of 60 rows, and each segment is transformed in an independent transformation using the 60 orthonormal signals to generate the transformed image data matrix.

Using the reduced line addressing method as described, approximately 3,600, i.e., $60^2$ operations are required for generation of the column voltages for a single column during each segment time. Because the frame period has been divided into eight segments, the total number of operations for generation of the column voltages for a single column during the frame period is approximately 28,800, i.e., 8 * 3,600. Therefore, in the above-described example, generating column values for driving a single column of a 480×640 display over an entire frame period using reduced line addressing requires only an eighth of the operations necessary for column voltage generation when the display is addressed as a whole. It will be appreciated that the reduced line addressing method therefore necessitates less power, less memory, and less time for performance of the required operations.

However, displays driven using reduced line addressing methods often have visible discontinuities at the boundaries of the display segments. The discontinuities result from the fact that, during generation of the column voltages, the actual image data is quantized as it is transformed due to limitations of hardware and software for performing the transformation. Therefore, the rms voltage applied to each pixel during the frame period cannot exactly reproduce the original image data, although the loss in data is not noticeable within each display segment because the column voltages for the rows of image data within each segment have been generated in a single transformation. The pixels at the boundaries of each display segment, however, are driven with column voltages generated in different transformations. As a result, discontinuities are introduced at the boundaries of the display segments, and, when viewed by the human eye, the image may not flow smoothly from one display segment to the next.

Thus, what is needed is method and apparatus for reducing discontinuities at the boundaries of an active-addressed display driven using reduced line addressing methods.

SUMMARY OF THE INVENTION

According to an aspect of the present invention, a method for addressing a display comprises the steps of driving a first plurality of rows of the display during a first set of time periods and driving a second plurality of rows of the display during a second set of time periods, wherein the second plurality of rows includes at least one overlapping row which is also included in the first plurality of rows.

According to another aspect of the present invention, an electronic device for presenting data comprises a display having at least first and second segments comprising, respectively, first and second pluralities of rows, wherein at least one overlapping row is included in both the first and second segments. A first driving circuit coupled to the display drives, during a first set of time periods, the first plurality of rows with a first set of orthonormal functions, including a first at least one modified orthonormal function for driving the at least one overlapping row, and a second driving circuit coupled to the display drives, during a second set of time periods, the second plurality of rows with a second set of orthonormal functions, including a second at least one modified orthonormal function for driving the at least one overlapping row.

BRIEF DESCRIPTION OF THE DRAWINGS

FIG. 3 is a matrix of Walsh functions in accordance with the present invention.

FIG. 4 depicts drive signals corresponding to the Walsh functions of FIG. 3 in accordance with the present invention.

DESCRIPTION OF A PREFERRED EMBODIMENT

Figure 1:
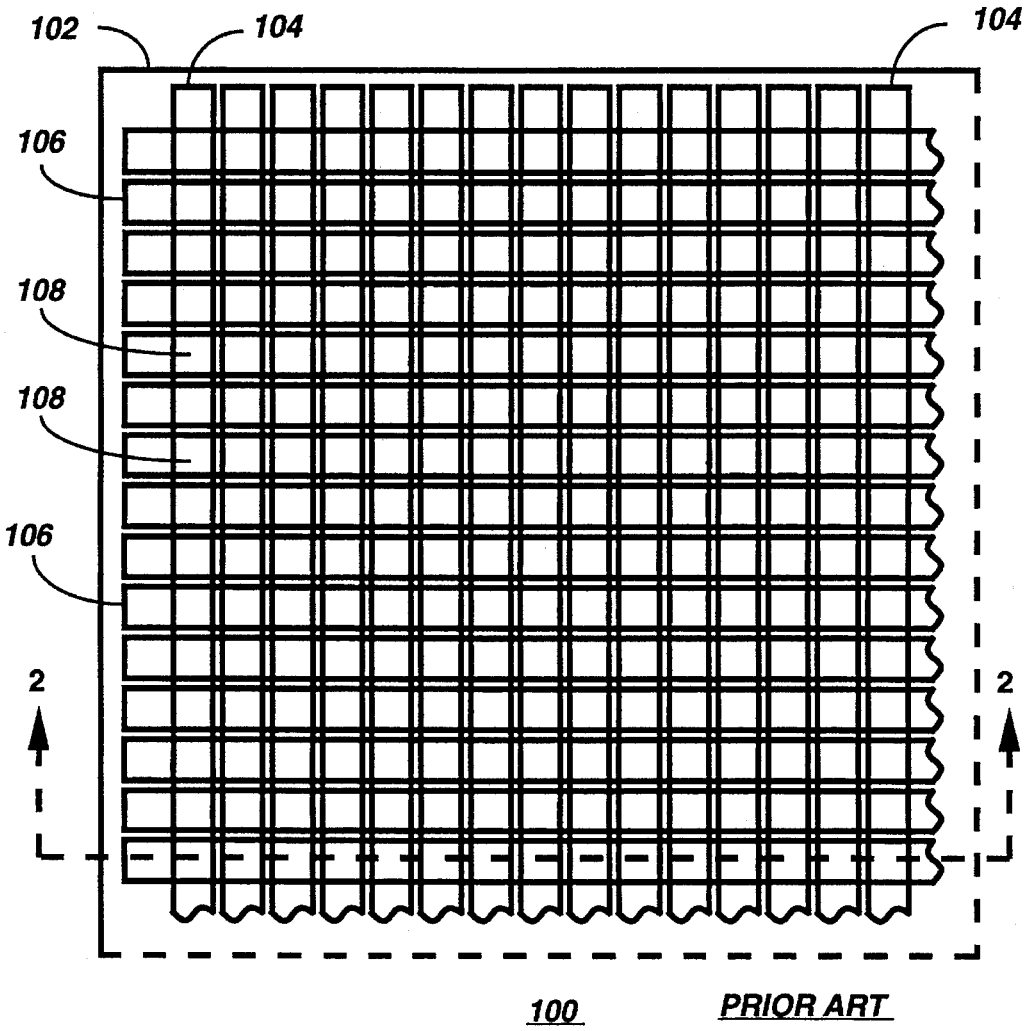
FIG. 1 is a front orthographic view of a portion of a conventional liquid crystal display.
Figure 2:
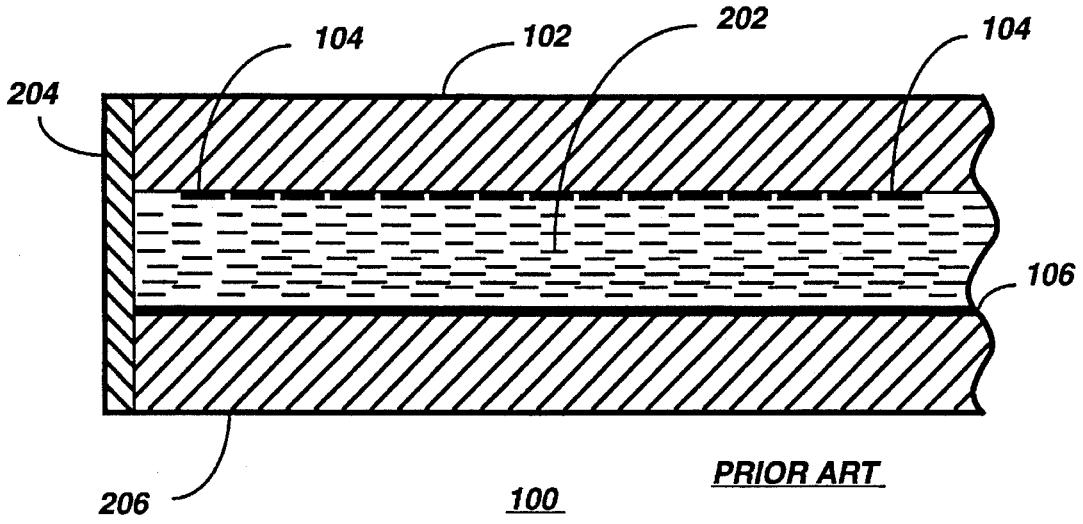
FIG. 2 is an orthographic cross-section view along the line 2—2 of FIG. 1 of the portion of the conventional liquid crystal display.

Referring to FIGS. 1 and 2, orthographic front and cross-section views of a portion of a conventional liquid crystal display (LCD) 100 depict first and second transparent substrates 102, 206 having a space therebetween filled with a layer of liquid crystal material 202. A perimeter seal 204 prevents the liquid crystal material from escaping from the LCD 100. The LCD 100 further includes a plurality of transparent electrodes comprising row electrodes 106 positioned on the second transparent substrate 206 and column electrodes 104 positioned on the first transparent substrate 102. At each point at which a column electrode 104 overlaps a row electrode 106, such as the overlap 108, voltages applied to the overlapping electrodes 104, 106 can control the optical state of the liquid crystal material 202 therebetween, thus forming a controllable picture element, hereafter referred to as a "pixel". While an LCD is the preferred display element in accordance with the preferred embodiment of the present invention, it will be appreciated that other types of display elements may be used as well, provided that such other types of display elements exhibit optical characteristics responsive to the square of the voltage applied to each pixel, similar to the root mean square (rms) response of an LCD.

Referring to FIGS. 3 and 4, an eight-by-eight (third order) matrix of Walsh functions 300 and the corresponding Walsh waves 400 in accordance with the preferred embodiment of the present invention are shown. Walsh functions are both orthogonal and normalized, i.e., orthonormal, and are therefore preferable for use in an active-addressed display system, as briefly discussed in the Background of the Invention herein above. It may be appreciated by one of ordinary skill in the art that other classes of functions, such as Pseudo Random Binary Sequence (PRBS) functions or Discrete Cosine Transform (DCT) functions, may also be utilized in active-addressed display systems.

When Walsh functions are used in an active-addressed display system, voltages having levels represented by the Walsh waves 400 are uniquely applied to a selected plurality of electrodes of the LCD 100. For example, the Walsh waves 404, 406, and 408 could be applied to the first (uppermost), second and third row electrodes 106, respectively, and so on. In this manner, each of the Walsh waves 400 would be applied uniquely to a corresponding one of the row electrodes 106. It is preferable not to use the Walsh wave 402 in an LCD application because the Walsh wave 402 would bias the LCD 100 with an undesirable DC voltage.

It is of interest to note that the values of the Walsh waves 400 are constant during each time slot t. The duration of the time slot t for the eight Walsh waves 400 is one-eighth of the duration of one complete cycle of Walsh waves 400 from start 410 to finish 412. When using Walsh waves for actively addressing a display, the duration of one complete cycle of the Walsh waves 400 is set equal to the frame duration, i.e., the time to receive one complete set of data for controlling all the pixels 108 of the LCD 100. The eight Walsh waves 400 are capable of uniquely driving up to eight row electrodes 106 (seven if the Walsh wave 402 is not used). It will be appreciated that a practical display has many more rows. For example, displays having four-hundred-eighty (480) rows and six-hundred-forty (640) columns are widely used today in laptop computers. Because Walsh function matrices are available in complete sets determined by powers of two, and because the orthonormality requirement for active addressing does not allow more than one electrode to be driven from each Walsh wave, a five-hundred-twelve by five-hundred-twelve ($2^9 \times 2^9$) Walsh function matrix would be required to drive a display having four-hundred-eighty row electrodes 106. For this case, the duration of the time slot t is 1/512 of the frame duration. Four-hundred-eighty Walsh waves would be used to drive the four-hundred-eighty row electrodes 106, while the remaining thirty-two, preferably including the first Walsh wave 402 having a DC bias, would be unused.

The columns of the LCD 100 are, at the same time, driven with column voltages derived by transforming the image data, which can be represented by a matrix of image data values, utilizing orthonormal functions representative of the Walsh waves 400. This transformation can be accomplished, for example, by using matrix multiplication, Walsh Transforms, modifications of Fourier Transforms, or other such algorithms. In accordance with active addressing methods, the rms voltage applied to each of the pixels of the LCD 100 during a frame duration approximates an inverse transformation of the column voltages, thereby reproducing the image data on the LCD 100.

Figure 5:
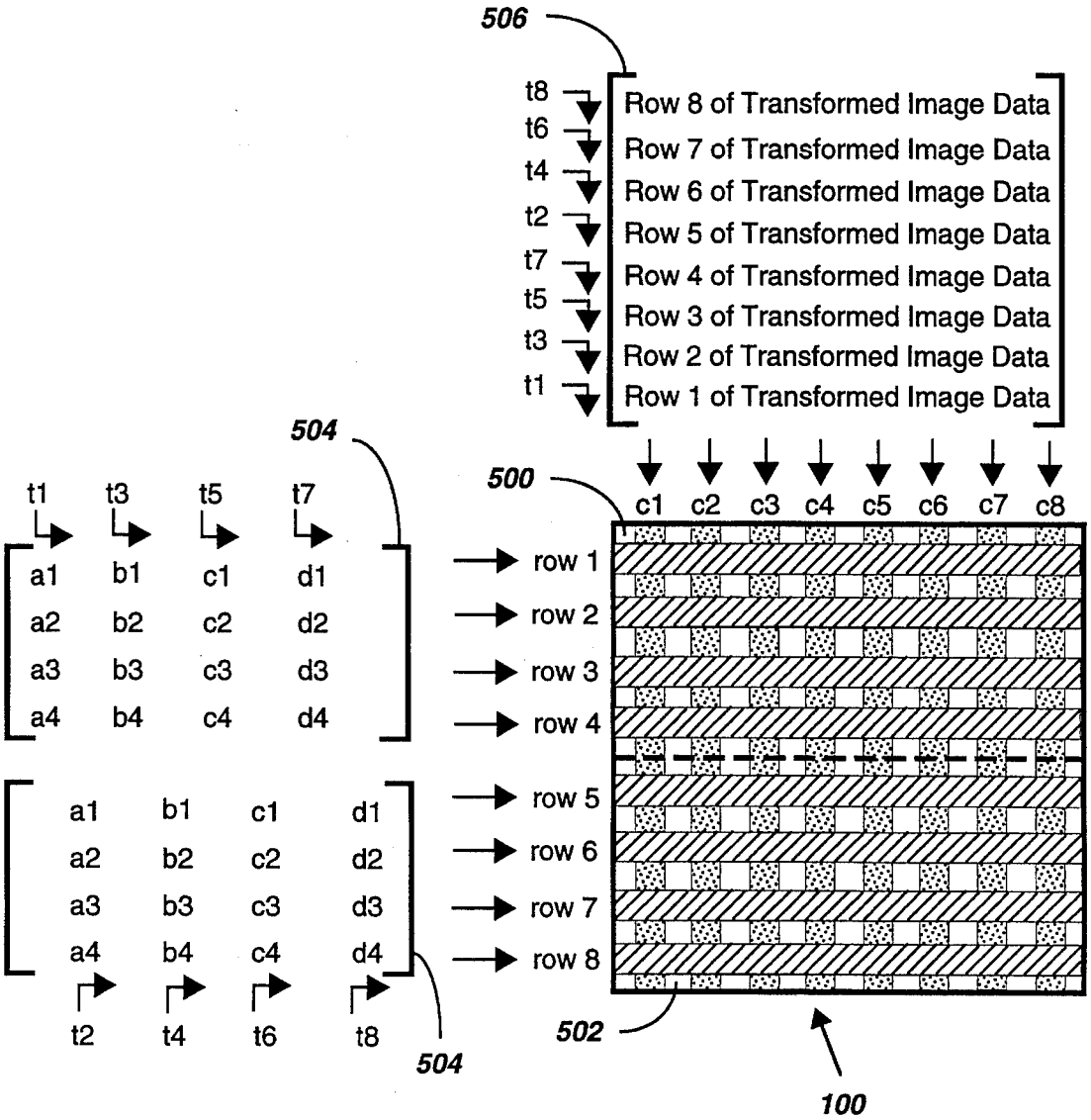
FIG. 5 PRIOR ART
FIG. 5 is a front orthographic view of a conventional liquid crystal display which is divided into segments that are addressed in accordance with conventional reduced line addressing techniques.

Referring next to FIG. 5, an illustration depicts a conventional active-addressed LCD, such as the LCD 100, which is driven in accordance with reduced line addressing techniques, thereby reducing the power necessary for driving the LCD 100, as described briefly hereinabove in the Background of the Invention. As shown, the LCD 100 is divided into segments, each of which comprises an equal number of rows. For illustrative purposes only, the LCD 100 is depicted as having only eight columns and eight rows, which are evenly divided into two segments 500, 502 of four rows each. The two segments 500, 502 are addressed separately using matrices of orthonormal functions, such as Walsh functions. Because each segment 500, 502 comprises only four rows, the matrix 504 used for driving each segment 500, 502 need only include four orthonormal functions having four values each. Additionally, the reduced-size matrix 504 is used for transforming subsets of the image data, which is preferably in the form of an image data matrix. For the current example, in which an eight-by-eight LCD 100 is divided into two segments 500, 502, the orthonormal function matrix 504 is used first to transform the first four rows of the image data matrix, and then to transform the second four rows of the image data, thereby generating a transformed image data matrix 506, which includes column values for driving columns of the LCD 100.

In operation, row drivers (not shown) are employed to drive, during a first time period, the first four rows of the LCD 100 with row voltages associated with the values in the first column of the orthonormal matrix 504. For instance, during the first time period, row 1 is driven with voltage a1, row 2 is driven with voltage a2, row 3 is driven with voltage a3 and row 4 is driven with voltage a4. At the same time, the columns are driven with voltages associated with values included in the first row of the transformed image data matrix 506. During the second time period, the second four rows of the LCD 100 are driven with row voltages associated with the values in the first column of the orthonormal matrix 504. Specifically, row 5 is driven with voltage a1, row 6 is driven with voltage a2, row 7 is driven with voltage a3, and row 8 is driven with voltage a4. At the same time, the columns of the LCD 100 are driven with voltages associated with values included in the fifth row of the transformed image data matrix 506, as shown. During the third time period, the first four rows of the LCD 100 are again driven, this time with row voltages associated with the values in the second column of the orthonormal matrix 504. Simultaneously, the columns are driven with voltages associated with values included in the second row of the transformed image data matrix 506. This operation continues until, after eight time periods, the rows of each of the segments have been addressed with all of the columns of the orthonormal matrix 504, and the columns of the LCD 100 have been addressed with all of the rows of the transformed image data matrix 506.

In reduced line addressing, the number of operations necessary for driving the columns of a display is greatly reduced when compared to the number necessary when an entire display is addressed as a whole. Therefore, reduced line addressing requires less power consumption and less memory. However, displays driven in segments often have visible discontinuities at the boundaries of the display segments. The discontinuities result from the fact that, after generation of the column values, the transformed image data is quantized. Therefore, the rms voltage applied to each pixel during the frame duration cannot exactly reproduce the original image data, although the loss in data is not noticeable within each display segment because the column voltages for the rows of image data within each segment have been generated utilizing a single transformation. The pixels at the boundaries of each display segment, however, are driven with column voltages generated in different transformations. As a result, discontinuities are introduced at the boundaries of the display segments, and, when viewed by the human eye, the image may not flow smoothly from one display segment to the next. These discontinuities can advantageously be reduced by utilizing an improved addressing method, which is described in greater detail below.

Figure 6:
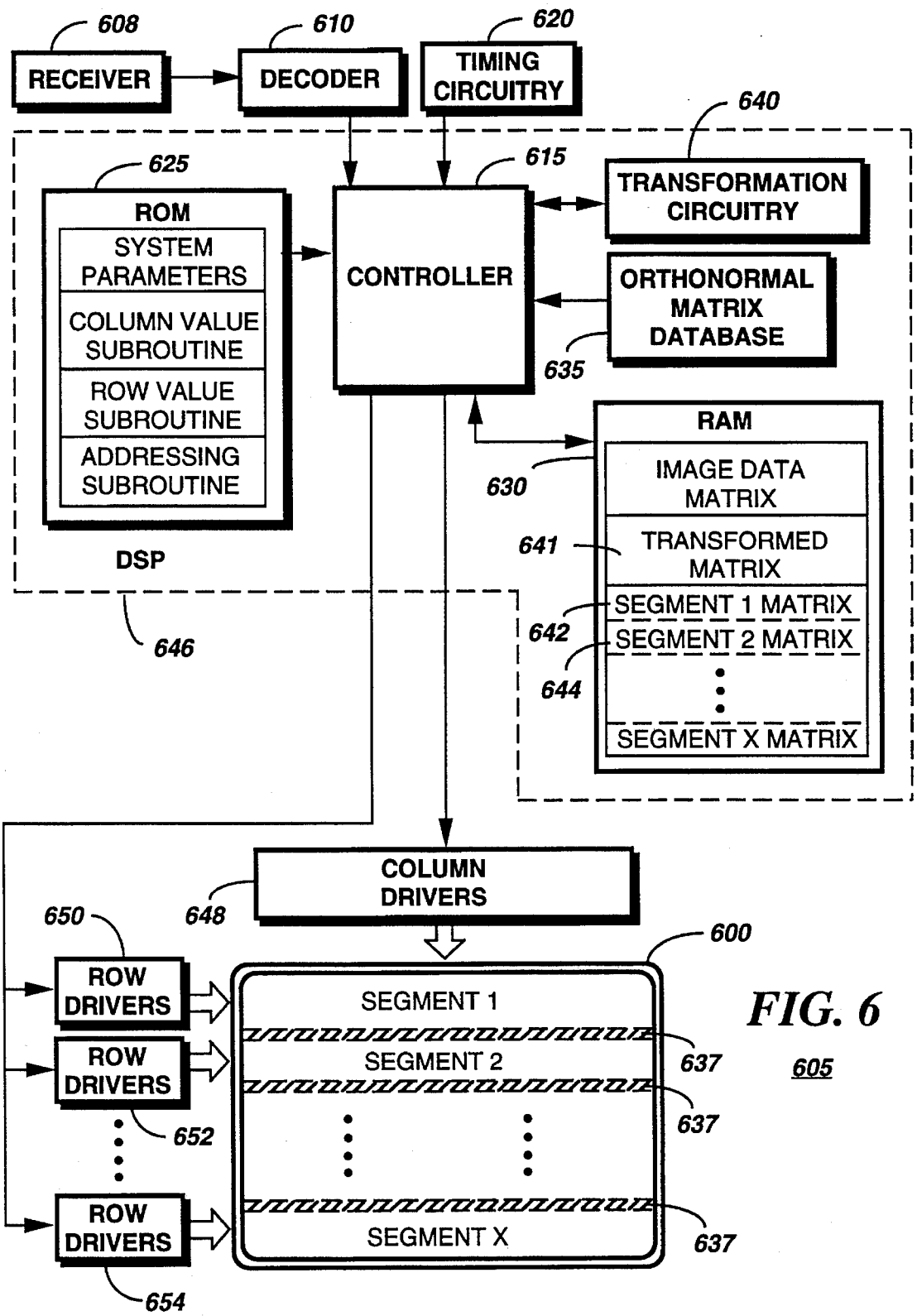
FIG. 6 is an electrical block diagram of an electronic device comprising a liquid crystal display which is addressed in accordance with the present invention.

FIG. 6 is an electrical block diagram of an electronic device which receives and displays image data on an LCD 600, the rows of which are divided into segments such that the LCD 600 can be addressed using reduced line addressing techniques, thereby reducing the amount of time, memory and power necessary for computation of column voltages. When the electronic device is a radio communication device 605, as shown, the image data to be displayed on the LCD 600 is included in a radio frequency signal, which is received and demodulated by a receiver 608 internal to the radio communication device 605. A decoder 610 coupled to the receiver 608 decodes the radio frequency signal to recover the image data therefrom in a conventional manner, and a controller 615 coupled to the decoder 610 further processes the image data.

Coupled to the controller 615 is timing circuitry 620 for establishing system timing. The timing circuitry 620 can, for example, comprise a crystal (not shown) and conventional oscillator circuitry (not shown). Additionally, a memory, such as a read only memory (ROM) 625, stores system parameters and system subroutines which are executed by the controller 615. A random access memory (RAM) 630, also coupled to the controller 615, is employed to store the incoming image data as an image data matrix and to temporarily store other variables derived during operation of the radio communication device 605.

Preferably, the radio communication device 605 further comprises an orthonormal matrix database 635 for storing a plurality of orthonormal functions in the form of a matrix. The orthonormal functions can be, for instance, Walsh functions, as described above, DCT functions, or PRBS functions, the number of which must be equal to or greater than the number of rows included in each segment of the LCD 600 which is to be addressed. It will be recognized by one of ordinary skill in the art that, when Walsh functions are used, the representative Walsh function matrix (not shown) may actually include a greater number of rows than necessary, as Walsh function matrices are available in complete sets determined by powers of two.

In accordance with the preferred embodiment of the present invention, the LCD 600 is divided into segments which comprise an equal number of rows. However, unlike LCDs addressed using conventional reduced line addressing techniques, the LCD 600 includes segments which overlap. More specifically, each segment of the LCD 600 includes at least one row 637 which is also included in another LCD segment. For example, a first LCD segment could include rows one through sixty of the LCD 600, while a second segment adjacent to the first segment could include rows sixty through one-hundred-nineteen. In this case, row sixty would be included in both the first and second segments of the LCD 600.

The radio communication device 605 further includes transformation circuitry 640 for generating column values for addressing columns of the LCD 600 in accordance with the preferred embodiment of the present invention. The transformation circuitry 640, which is coupled through the controller 615 to the orthonormal matrix database 635, transforms subsets of the image data utilizing a set of orthonormal functions, thereby generating column values. The subsets of the image data are preferably rows of the image data matrix which correspond to the rows included in the segments of the LCD 600.

By way of example, when the LCD 600 is divided into first and second segments, each comprising sixty rows, the first sixty rows of the image data matrix are transformed using sixty orthonormal functions stored in the orthonormal matrix database 635, thereby generating a first set of transformed image data values, i.e., column values. The first set of transformed image data values is a subset of the total number of column values, which are stored in the form of a "transformed matrix" 641 in the RAM 630. Thereafter, rows sixty through one-hundred-nineteen of the image data matrix are transformed using the same sixty orthonormal functions, thereby generating a second set of transformed image data values for storage as values in the transformed matrix 641. It will be appreciated that, in this manner, the sixtieth row and any other overlapping rows 637 will be transformed twice: once during calculations involving the rows of the image data matrix which correspond to LCD rows included in the first segment, and once during calculations involving the rows of the image data matrix which correspond to LCD rows included in the second segment. This procedure is followed until the entire image data matrix has been transformed utilizing the orthonormal functions stored in the orthonormal matrix database 635, at which point all of the column values included within the transformed matrix 641 have been generated.

The transformation circuitry 640 transforms the image data using an algorithm such as a Fast Walsh Transform, a modification of a Fast Fourier Transform, or matrix multiplication. When matrix multiplication is employed, the transformation can be approximated by the following equation:

$$CV=OM*I,$$

wherein I represents the subset of the image data matrix to be transformed, OM represents a matrix formed from the set of orthonormal functions, and CV represents the column values generated by the multiplication of the image data and the orthonormal functions.

Values for driving the rows of the LCD 600 are also generated from the orthonormal functions, some of which are modified by the controller 615. More specifically, the controller 615 divides in half the coefficients of orthonormal functions which correspond to overlapping rows 637 of the LCD 600 and stores these sets of modified functions in the RAM 630. When, for instance, the LCD 600 comprises first and second segments, each having sixty rows, a first row calculation is performed in which the coefficients of the last orthonormal function are divided by two because the last orthonormal function, i.e., the sixtieth orthonormal function, corresponds to the sixtieth row, i.e., the overlapping row 637, in the first segment. This first modified set of functions is stored as a first "segment matrix" 642 in the RAM 630. In a second segment row calculation, the coefficients of the first orthonormal function are divided by two, thereby generating a second set of modified functions, which is stored as a second segment matrix 644 in the RAM 630. The first orthonormal function is modified because, for the second segment of the LCD 600, the first orthonormal function corresponds to the overlapping row 637, i.e., the sixtieth row of the LCD 600. It will be appreciated that, if the second segment includes a second overlapping row 637, such as when the LCD 600 includes a third segment adjacent to and overlapping the second segment, an orthonormal function corresponding to the second overlapping row 637 will also be modified before storage in the second segment matrix 644. This operation is continued until segment matrices corresponding to each of the LCD segments are calculated and stored in the RAM 630.

According to the present invention, further coupled to the controller 615 are column drivers 648 for driving columns of the LCD 600 with column voltages associated with the column values included in the rows of the transformed matrix 641. Additionally, row drivers 650, 652, 654 coupled to the controller 615 drive the rows of the LCD 600 with row voltages corresponding to the columns of the segment matrices 642, 644. Preferably, one set of row drivers 650, 652, 654 are utilized for each segment of the LCD 600 which is to be addressed.

It will be recognized that the controller 615, the ROM 625, the RAM 630, the orthonormal matrix database 635, and the transformation circuitry 640 can be implemented in a digital signal processor 646, such as the DSP 65000 manufactured by Motorola, Inc. However, in alternate embodiments of the present invention, the listed elements can be implemented utilizing discrete components. The column drivers 648 can be implemented using model no. SED1779D0A column drivers manufactured by Seiko Epson Corporation, and the row drivers 650, 652, 654 can be implemented using model no. SED1704 row drivers, also manufactured by Seiko Epson Corp. However, other row and column drivers which operate in a similar manner may also be employed. Circuits, such as column and row drivers, and techniques for driving LCDs are taught in the U.S. Patent Application entitled "Method and Apparatus for Driving an Electronic Display" by Herold, Attorney's Docket No. PT00843U, which is assigned to the assignee hereof, and which is hereby incorporated by reference.

In accordance with the present invention, the overlapping rows 637 of the LCD 600 are, as will be described in greater detail below, driven both with voltages intended for driving a first segment and voltages intended for driving a second segment, wherein the voltages are only half of their conventional value, i.e., the value associated with the orthonormal function. Therefore, rather than being turned on when the first segment is addressed and turned off when the second segment is addressed, as in the prior art, the rows at the borders of the segments, which are overlapping rows 637, are turned on for twice the conventional time at half the conventional voltage. This addressing method helps to reduce sharp discontinuities at the borders of the segments. Additionally, as described above, the rows of the image data matrix which correspond to the overlapping rows 637 are transformed in two different transformations during generation of the column values, which further smooths the display of the image data between the different segments of the LCD 600. Conversely, in LCDs addressed using conventional methods, rows at the borders of LCD segments are addressed separately, and the rows of the image data matrix corresponding to border rows are transformed in unrelated transformations. As a result, noticeable discontinuities, which are very undesirable from a user standpoint, are present at the borders of the different LCD segments.

Figure 7:
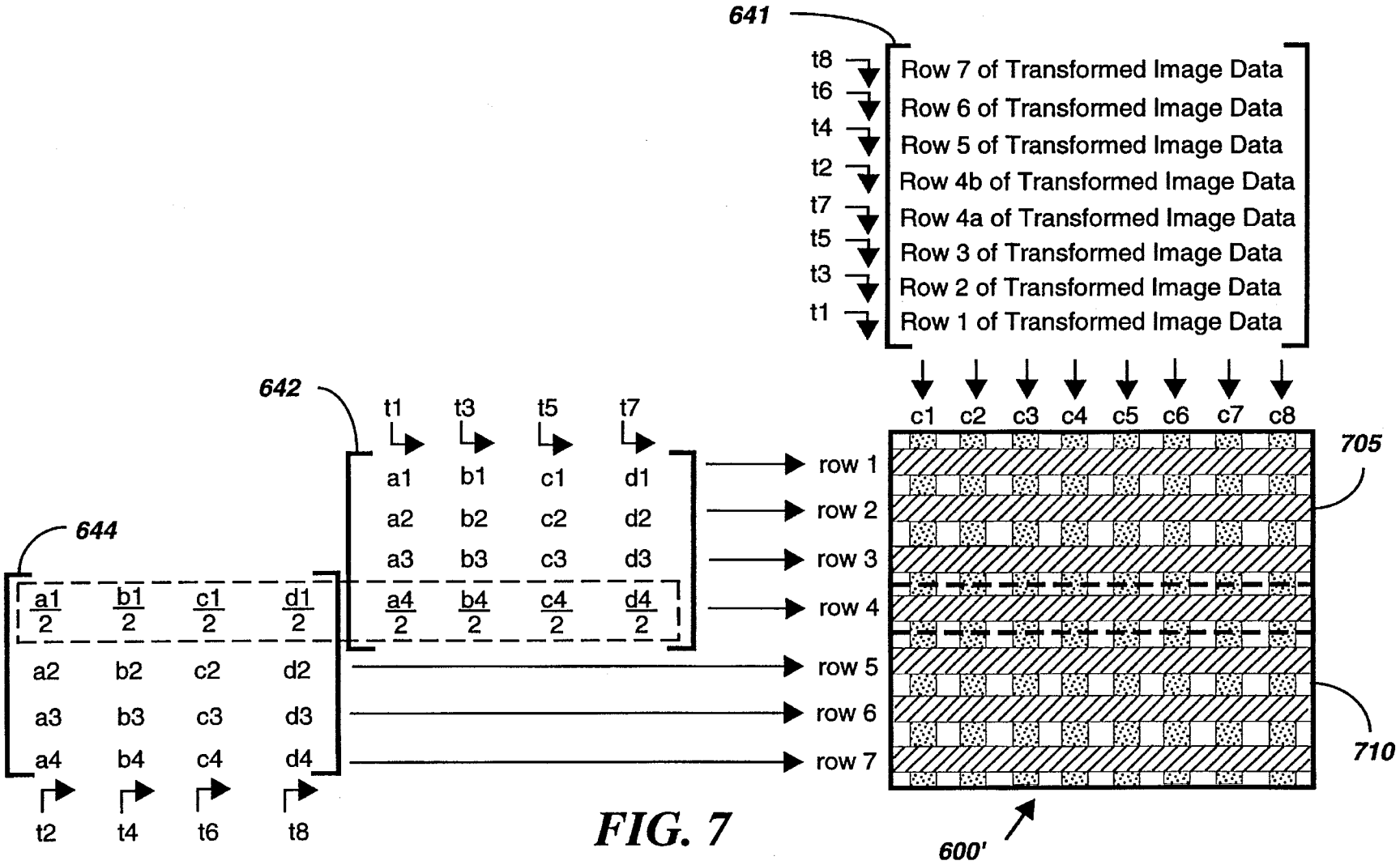
FIG. 7 depicts a matrix associated with column voltages and matrices associated with row voltages for driving a liquid crystal display having two segments which include an overlapping row of electrodes in accordance with the present invention.

Referring next to FIG. 7, matrices associated with voltages used in addressing an LCD 600' are depicted. For illustrative purposes only, the LCD 600' is shown as including two segments 705, 710 having four rows each, although it will be appreciated that an LCD of any size and including any number of segments can be addressed utilizing the addressing method according to the present invention. As shown, the segments 705, 710 overlap such that row 4 is shared. The rows included in the first segment 705 are addressed with voltages corresponding to a first segment matrix 642, which is calculated in the above-described manner, and the rows included in the second segment 710 are addressed with voltages corresponding to a second segment matrix 644. Simultaneously, the columns of the LCD 600' are addressed with voltages corresponding to a transformed matrix 641, the values of which have been calculated in a transformation of the image data by the orthonormal functions stored in the orthonormal matrix database 635, as described above. The addressing of the LCD 600' can be better understood by further referencing FIGS. 8–11 in conjunction with FIG. 7.

Figure 8:
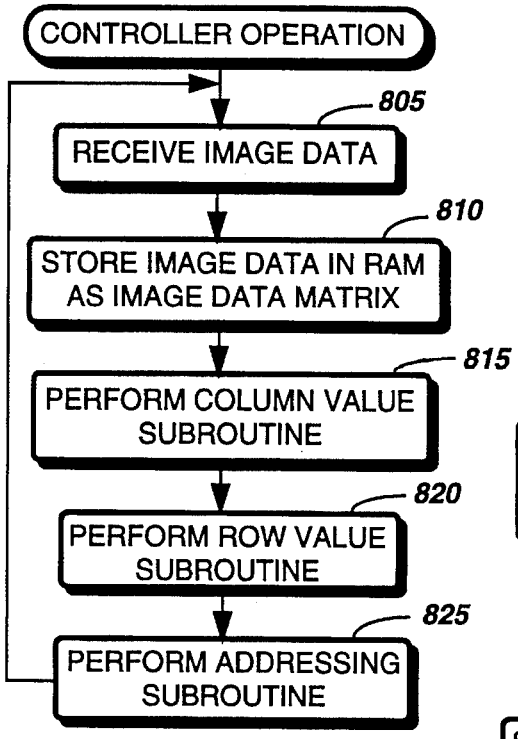
FIGS. 8–11 are flowcharts illustrating the operation of a controller included in the electronic device of FIG. 6 when driving the liquid crystal display of FIG. 7 in accordance with the present invention.

FIGS. 8–11 are flowcharts illustrating the operation of the controller 615 (FIG. 6) in accordance with the preferred embodiment of the present invention. Referring to FIG. 8, the controller 615 receives, at step 805, image data from the decoder 610. The image data is thereafter stored, at step 810, in the RAM 630 as an image data matrix. Subsequently, the controller 615 performs, at steps 815, 820, column and row value subroutines prior to performing, at step 825, an addressing subroutine in which the LCD 600' is addressed.

Figure 9:
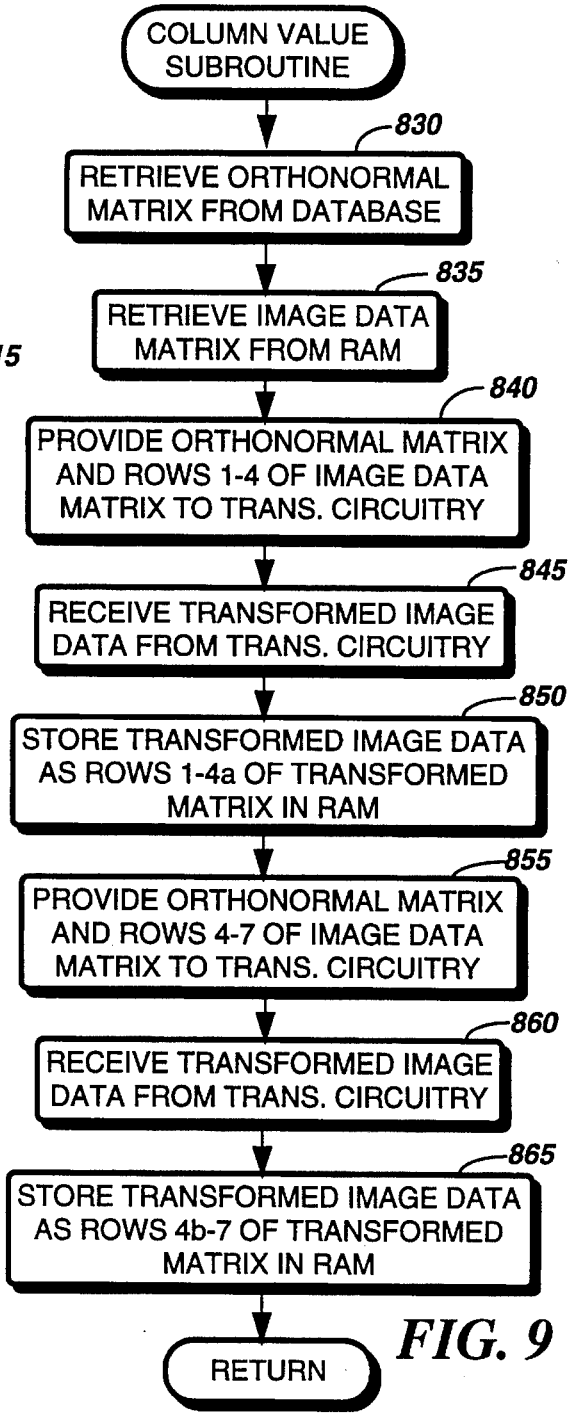

Referring to FIG. 9, the controller 615, after storing the image data, retrieves the orthonormal matrix, which comprises the orthonormal functions, from the orthonormal matrix database 635 (FIG. 6), at step 830. Additionally, the controller 615 retrieves, at step 835, the image data matrix from the RAM 630. The orthonormal matrix and rows 1–4 of the image data matrix are thereafter provided, at step 840, to the transformation circuitry 640 for transformation thereby to generate column values in the manner described above. At steps 845, 850, the column values, i.e., the transformed image data values, are received by the controller 615 and stored as rows 1–4*a* of the transformed matrix 641 (FIG. 7) in the RAM 630. The controller 615 further provides the transformation circuitry 640 with the orthonormal matrix and rows 4–7 of the image data matrix, at step 855. The transformed image data values, which are received by the controller 615 at step 860, are then stored, at step 865, as rows 4*b*–7 of the transformed matrix 641 in the RAM 630.

Figure 10:
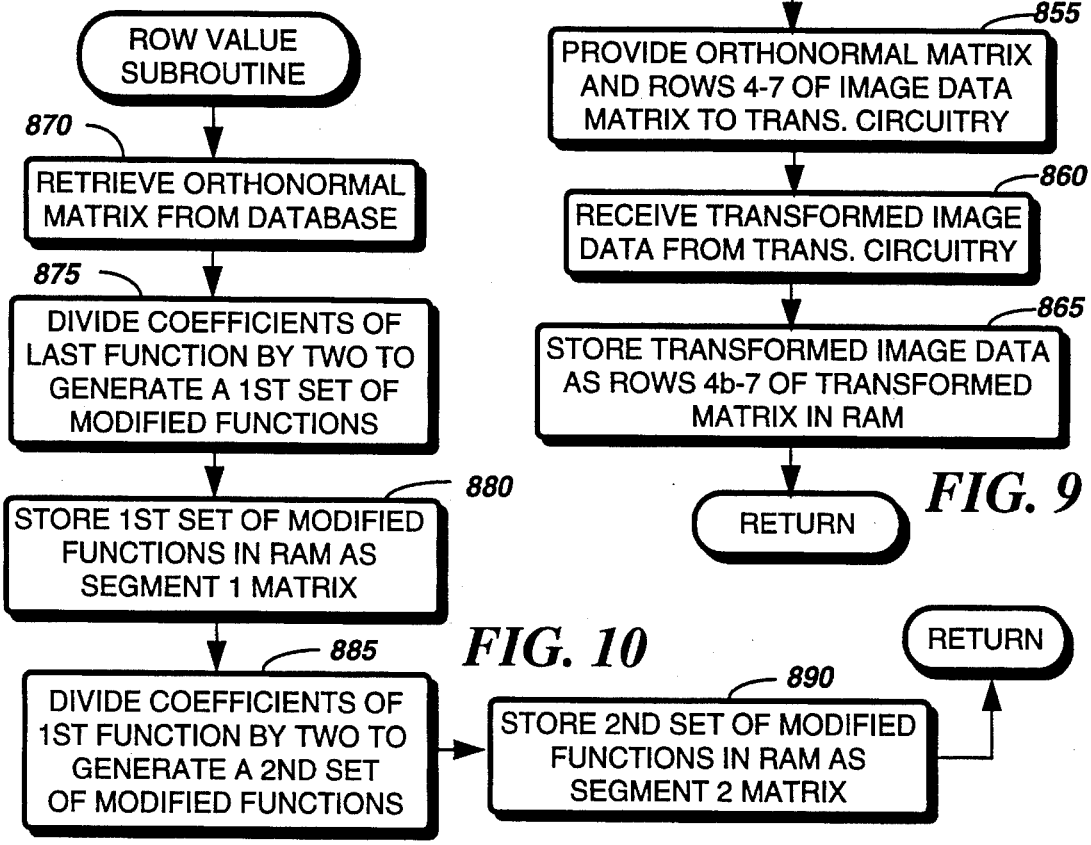

The row value subroutine depicted in FIG. 10 is thereafter performed by the controller 615. After retrieving the orthonormal matrix from the database 635, at step 870, the controller 615 divides, at step 875, the coefficients of the last orthonormal function by two to generate a set of modified functions, which are stored, at step 880, in the RAM 630 as a first segment matrix 642 (FIG. 7). In a separate computation, the controller 615 divides, at step 885, the coefficients of the first orthonormal function by two to generate another set of modified functions. This second set is stored, at step 890, as a second segment matrix 644.

Figure 11:
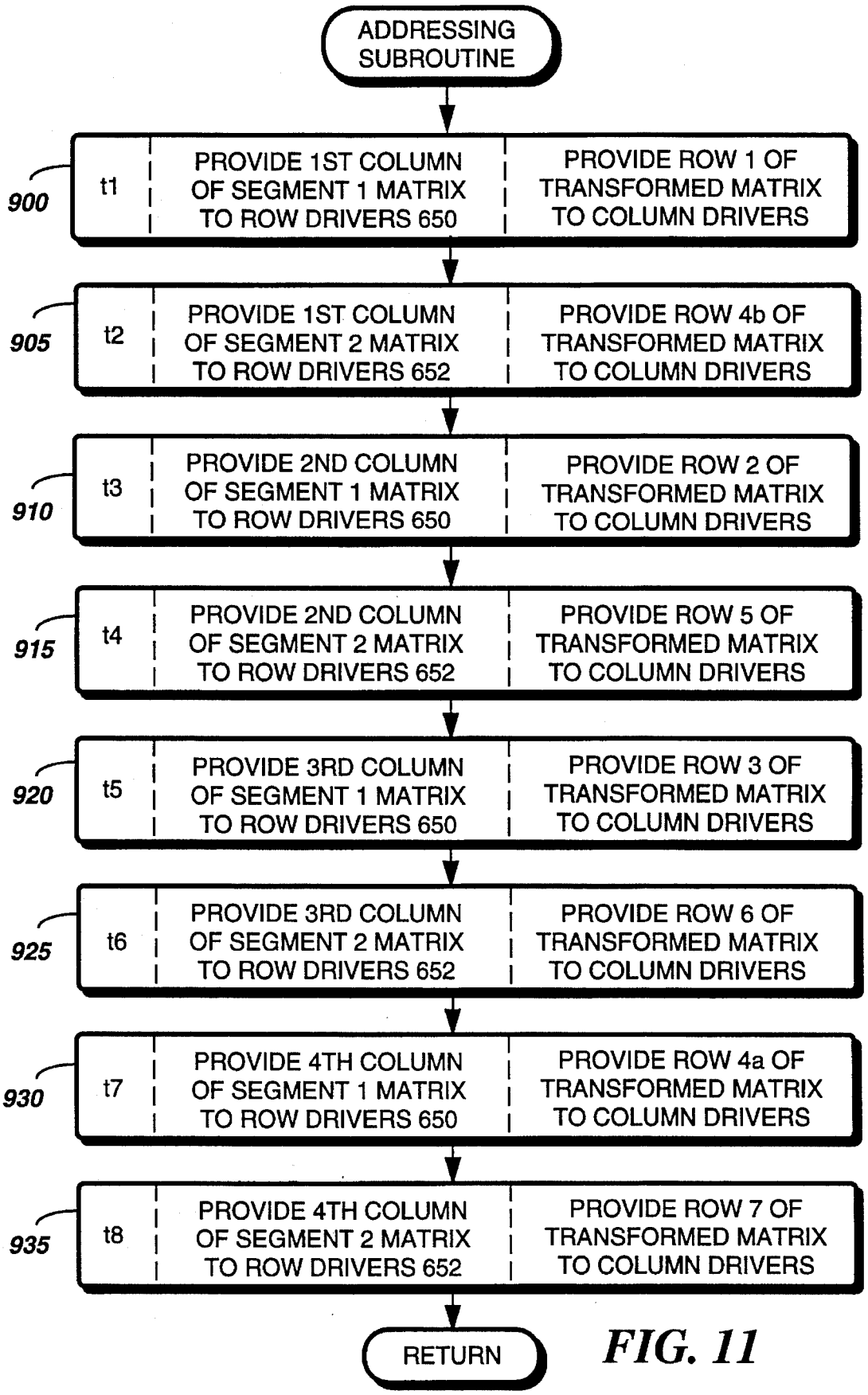

Once the transformed matrix 641 and the first and second segment matrices 642, 644 have been calculated, the LCD 600' can be addressed, as shown in FIG. 11. During a first time period, t1, which is an eighth of the frame duration, the controller 615 provides, at step 900, the first column of the first segment matrix 642 (FIG. 7) to row drivers 650 (FIG. 6). Row drivers 650 drive rows 1–4 of the LCD 600' with voltages corresponding to the first column of the first segment matrix 642 (FIG. 7). At the same time, row 1 of the transformed matrix 641 is provided to the column drivers 648, which drive the columns of the LCD 600' with column voltages approximating the values included in the first row of the transformed matrix 641. Subsequently, during time period t2, the first column of the second segment matrix 644 is provided, at step 905, to row drivers 652, which drive rows 4–7 of the LCD 600' with voltages corresponding to the values in the first column of the second segment matrix 644. Simultaneously, the column drivers 648 are provided with row 4*b* of the transformed matrix 641. During this time, row drivers 650 are turned off, i.e., row drivers 650 are provided with values equivalent to zero volts. It will be appreciated that, although not specifically recited in the following description, each set of row drivers 650, 652 is turned off after the time period in which it is used.

During time period t3, the controller 615, at step 910, provides row drivers 650 with the second column of the first segment matrix 642 and provides the column drivers 648 with row 2 of the transformed matrix 641. Thereafter, during time period t4, row drivers 652 receive the second column of the second segment matrix 644, and the column drivers 648 receive row 5 of the transformed matrix 641. This operation continues through steps 920, 925, 930, and 935 until all of the time periods t1–t8 have passed, during which the rows of the LCD 600' are addressed with all of the columns of the first and second segment matrices 642, 644 and the columns of the LCD 600' are addressed with all of the rows of the transformed matrix 641, as shown in FIG. 7.

By using the addressing method as described above, discontinuities between the two segments 705, 710 are reduced. This smoothing effect occurs because the overlapping row included in both segments 705, 710 is addressed for twice the conventional amount of time with only half the conventional voltage, and because rows of the image data matrix corresponding to the overlapping row of the LCD 600'have been transformed in two different transformations, thereby avoiding a sharp transition between column values. For the above example, row 4 of the image data matrix, which corresponds to the overlapping LCD row, has been transformed in two different transformations to yield two rows of the transformed matrix 641. This results in a display which has a much less abrupt discontinuity between segments than does an LCD addressed using conventional reduced line addressing techniques.

Figure 12:
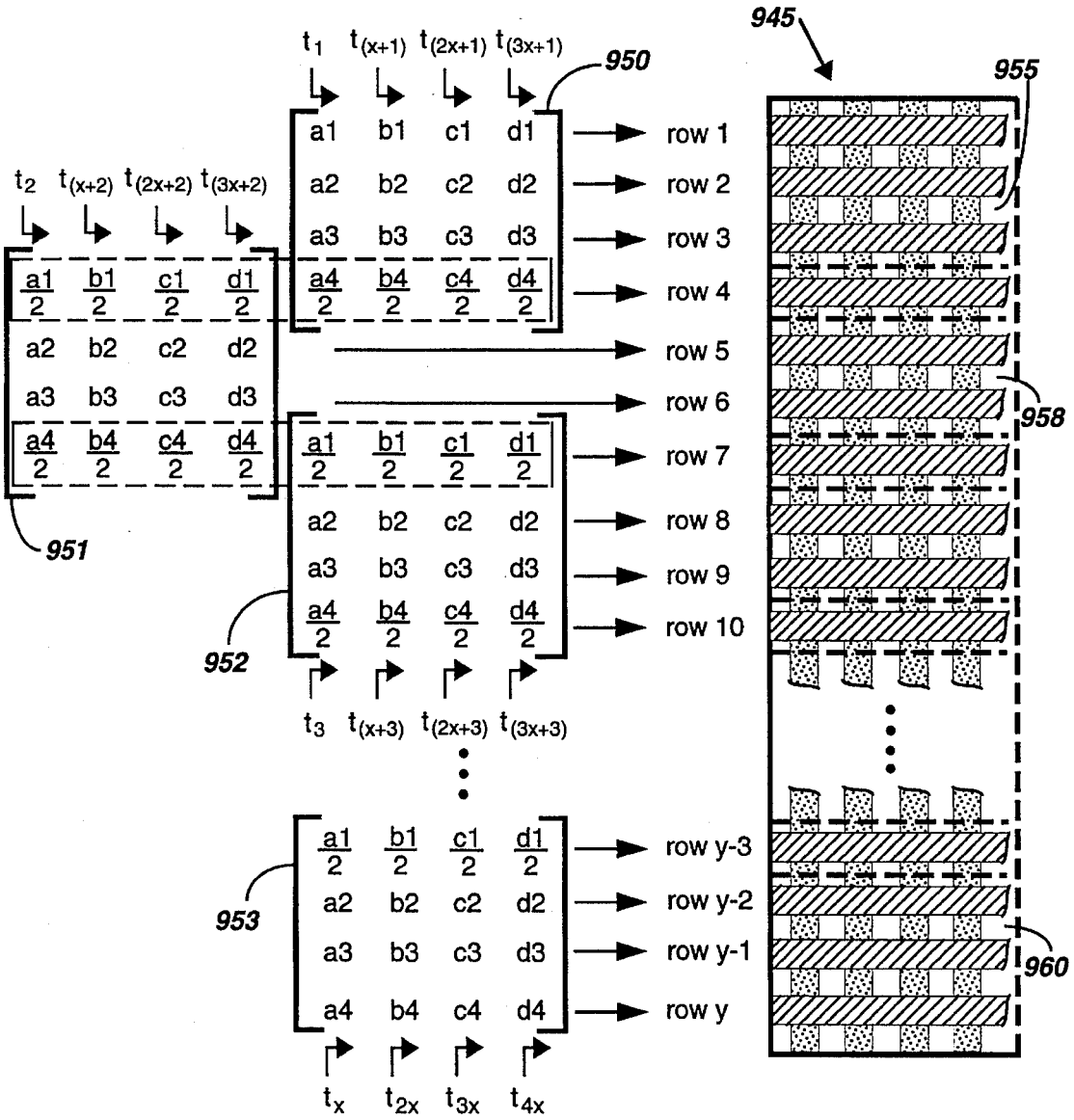
FIG. 12 depicts matrices associated with row voltages for driving a liquid crystal display having a plurality of segments, each of which shares an overlapping row of electrodes with an adjacent segment, in accordance with the present invention.
Figure 13:
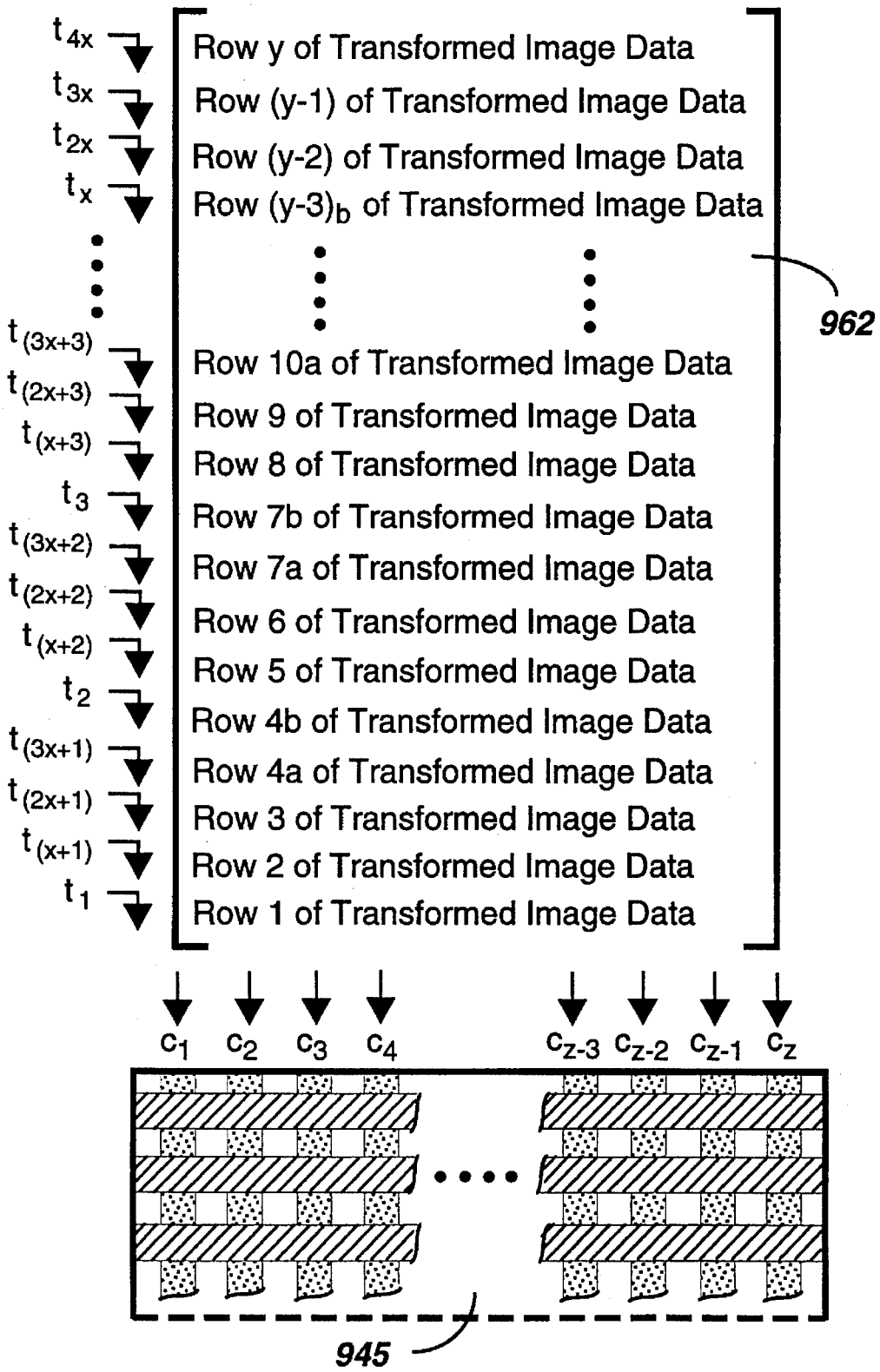
FIG. 13 depicts a matrix associated with column voltages for driving the liquid crystal display of FIG. 13 in accordance with the present invention.

As mentioned above, the LCD 600'is shown as having only two segments 705, 710 (FIG. 7) to simplify the description of the addressing method according to the present invention. It will be appreciated, however, that an LCD having any number of segments can be addressed using the above-described addressing method, as shown in FIGS. 12 and 13. FIG. 12 depicts segments matrices 950, 951,952, 953 which are calculated from a set of four orthogonal functions and which are utilized to drive rows of an LCD 945 having z columns and y rows divided into x segments, wherein each segment comprises four of the y rows. The fourth row of a first segment matrix 950, which drives, for example, a first segment 955 of the LCD 945, has been previously calculated by dividing the coefficients of the fourth orthonormal function by two. The second segment matrix 951, which drives the second segment 958 of the LCD 945, comprises a first row which has been previously calculated by dividing the coefficients of the first orthonormal function by two. Additionally, the coefficients of the fourth orthonormal function have been divided by two to generate the fourth row of the second segment matrix 951. The first and fourth rows of the third segment matrix 952 have been similarly calculated, i.e., by dividing the coefficients of the first and fourth orthonormal functions, respectively, by two. It will be appreciated that, in the last segment matrix 953, only the first row, which drives the last segment 960 of the LCD 945 and which corresponds to overlapping row (y-3), is generated by dividing the coefficients of an orthonormal function by two. Voltages associated with the columns of each of the segment matrices 950, 951, 952, 953 are distributed in time as described above in reference to FIGS. 7 and 11.

FIG. 13 depicts the transform matrix 962 associated with voltages for driving the z columns of the LCD 945. The transform matrix 962 preferably includes a single row of values for each row of the image data matrix which is associated with a non-overlapping row of the LCD 945. Additionally, for each row of the image data matrix which is associated with an overlapping row in the LCD 945, the transform matrix 962 includes two rows, each of which has been generated in a different transformation. Voltages associated with the rows of the transform matrix 962 are applied to the columns of the LCD 945 at the different time periods shown in FIG. 13.

Figure 14:
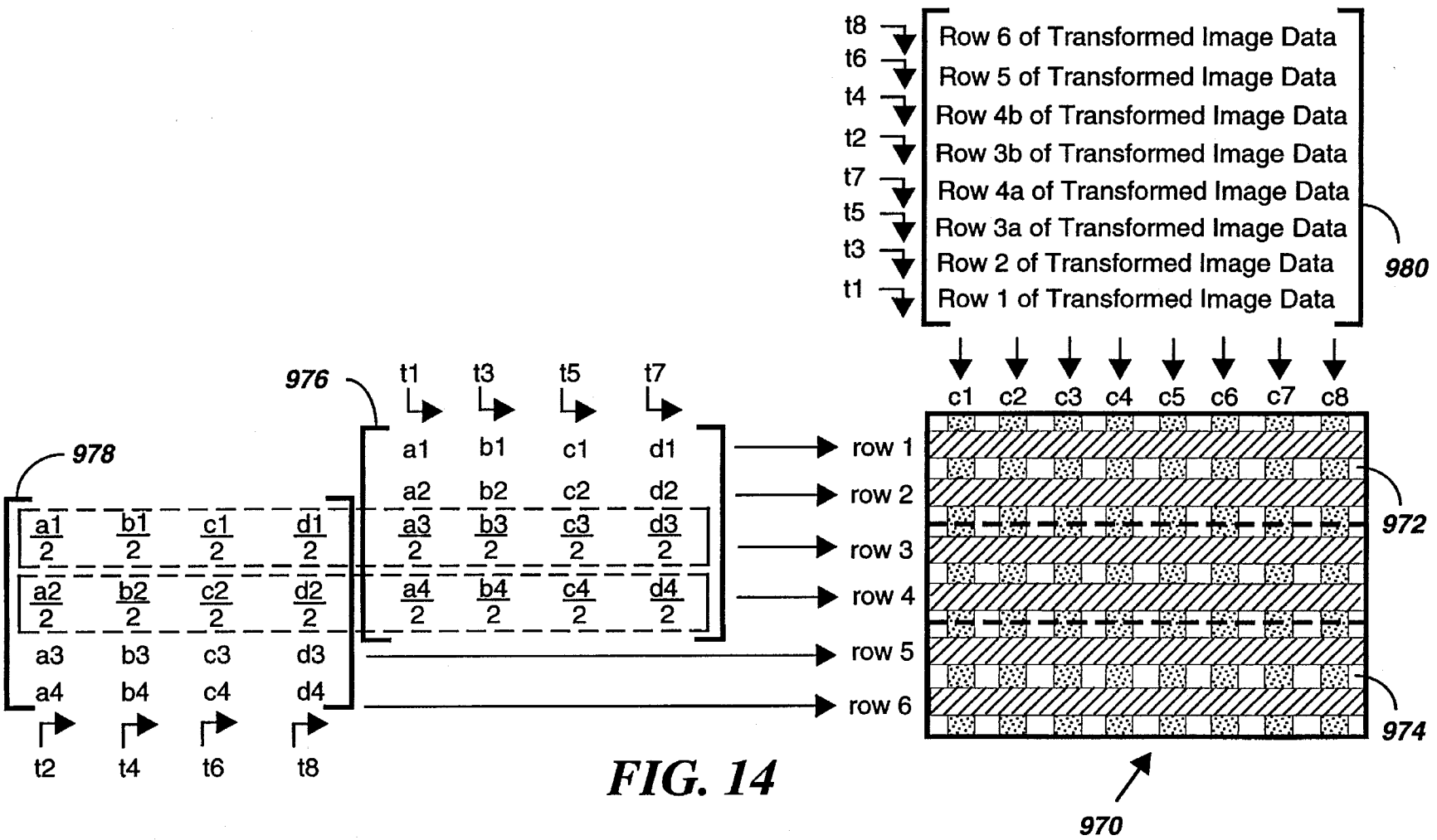
FIG. 14 depicts a matrix associated with column voltages and matrices associated with row voltages for driving a liquid crystal display having two segments which include a plurality of overlapping rows of electrodes in accordance with the present invention.

Although the previous examples have described LCDs which include segments having only a single overlapping row, it will be recognized that the addressing method according to the present invention can be expanded to address LCDs having segments which include more than a single overlapping row, thereby further smoothing the discontinuities at the boundaries of the segments. FIG. 14 depicts an LCD 970 having two segments 972, 974 which share two overlapping rows. A first segment matrix 976 for addressing the first segment 972 comprises four rows, two of which generated by modifying orthonormal functions. More specifically, the first and second rows of the first segment matrix 976 correspond to the first two of a set of four orthonormal functions. The third row of the first segment matrix 976 is preferably formed by dividing the coefficients of the third orthonormal function by two, and the fourth row is formed by dividing the coefficients of the fourth orthonormal function by two. The second segment matrix 978 also includes four rows. However, the first two rows, rather than the last two, are generated by modifying orthonormal functions. The first row of the second segment matrix 978 is formed by dividing the coefficients of the first orthonormal function by two, and the second row is formed by dividing the coefficients of the second orthonormal function by two.

Similar to the matrices in the above examples, the transform matrix 980 for addressing the columns of the LCD 970 includes a single row for each of the rows of the image data matrix which corresponds to a nonoverlapping row of the LCD 970. Two rows are included in the transform matrix 980 for each of the rows of the image data matrix which corresponds to an overlapping row of the LCD 970. Therefore, the transform matrix 980 includes two rows, i.e., rows 3*a* and 3*b*, which have been generated by transforming the third row of the image data matrix in two different transformations and two rows, i.e., rows 4*a* and 4*b*, which have been generated by transforming the fourth row of the image data matrix in two different transformation.

It will be appreciated by one of ordinary skill in the art that the addressing method according to the present invention can be easily adapted for use with other LCDs which combine characteristics of the LCDs described above. For instance, the improved addressing method can be used for addressing LCDs having both a large number of segments and a large number of overlapping rows between adjacent segments.

In summary, the addressing method described above is employed to drive LCDs which have been divided into a plurality of segments, each having an equal number of rows. In this manner, the number of operations required for calculating column voltages for driving columns of the LCD can be substantially reduced as compared to conventional active addressing methods. The reduced calculations necessitate less power consumption, less time, and less space in memory. Furthermore, in accordance with the present invention, the LCD segments overlap, i.e., adjacent segments share rows of the LCD. The row voltages for addressing overlapping rows of the LCD are consequently calculated by dividing in half coefficients of the conventional orthonormal functions used in active addressing, and the overlapping rows are driven for twice the conventional amount of time. Additionally, the column voltages for driving columns of the LCD are generated by transforming, in two different transformation, rows of received image data which correspond to overlapping LCD rows. In this manner, discontinuities which typically result from conventional reduced line addressing methods can be advantageously reduced without sacrificing the reduced power consumption which results from addressing LCDs in segments. These discontinuities can be even further reduced, thereby smoothing the display of an image, by increasing the number of overlapping rows in segments of an LCD.

It will be appreciated by now that there has been provided a method and apparatus for reducing discontinuities at the boundaries of an active-addressed display which is divided into segments to reduce the number of necessary addressing calculations.

What is claimed is:

1. A method for addressing a display, the method comprising the steps of:

transforming a first subset of received image data utilizing a plurality orthonormal functions to generate a first plurality of column voltages;

transforming a second subset of the received image data utilizing the plurality of orthonormal functions to generate a second plurality of column voltages, wherein a portion of the second subset of the received image data is also included in the first subset of the received image data such that the portion is transformed twice;

driving a first plurality of rows of the display during a first set of time periods;

applying the first plurality of column voltages to columns of the display during the first set of time periods;

driving a second plurality of rows of the display during a second set of time periods, wherein the second plurality of rows includes at least one display row which is also driven during the first set of time periods; and applying the second plurality of column voltages to the columns of the display during the second set of time periods.

2. The method according to claim 1, wherein the step of driving the first plurality of rows of the display comprises the steps of:

deriving a first set of row voltages from the plurality of orthonormal functions, wherein coefficients of at least a fast orthonormal function included in the plurality of orthonormal functions are divided by two prior to derivation of a first subset of corresponding row voltages included in the first set of row voltages; and applying the first set of row voltages to the first plurality of rows during the first set of time periods, wherein the first subset of corresponding row voltages is applied to the at least one display row that is driven during both the first and second sets of time periods.

3. The method according to claim 2, wherein the step of driving the second plurality of rows of the display comprises the steps of:

deriving a second set of row voltages from the plurality of orthonormal functions, wherein coefficients of at least a second orthonormal function included in the plurality of orthonormal functions are divided by two prior to derivation of a second subset of corresponding row voltages included in the second set of row voltages; and applying the second set of row voltages to the second plurality of rows during the second set of time periods, wherein the second subset of corresponding row voltages is applied to the at least one display row that is driven during both the first and second sets of time periods.

4. The method according to claim 1, wherein the received image data is processed in the form of an image data matrix, and wherein the step of transforming the first subset of the received image data comprises the step of:

transforming a first subset of rows of the image data matrix utilizing the plurality of orthonormal functions to generate the first plurality of column values.

5. The method according to claim 4, wherein the step of transforming the second subset of the received image data comprises the step of:

transforming a second subset of rows of the image data matrix utilizing the first plurality of orthonormal functions to generate the second plurality of column values, wherein the second subset of rows includes at least one image data row that is also included in the first subset of rows such that the at least one image data row is transformed twice.

6. An electronic device for presenting data, the electronic device comprising:

a receiver for receiving image data;

a display having at least first and second segments comprising, respectively, first and second pluralities of rows;

first driving means coupled to the display for driving, during a first set of time periods, the first plurality of rows with a plurality of orthonormal functions, at least one of which has been modified to generate a first modified orthonormal function;

second driving means coupled to the display for driving, during a second set of time periods, the second plurality of rows with the plurality of orthonormal functions, at least one of which has been modified to generate a second modified orthonormal function wherein:

at least one display row included in the second pluralities of rows is also included in the first plurality of rows such that the at least one display row is driven during both the first and second sets of time periods;

the at least one display row is driven with the first modified orthonormal function during the first set of time periods and with the second modified orthonormal function during the second set of time periods; and transforming circuitry for transforming a first subset of the image data utilizing the plurality of orthonormal functions to generate a first set of column voltages used to drive columns of the display during the first set of time periods, and for transforming a second subset of the image data utilizing the plurality of orthonormal functions to generate a second set of column voltages used to drive the columns of the display during the second set of time periods, wherein a portion of the image data is included in both the first and second subsets thereof such that the portion is transformed twice using the plurality of orthonormal functions.

7. The electronic device according to claim 6, further comprising a memory for storing the plurality of orthonormal functions.

8. The electronic device according to claim 6, wherein:

the first modified orthonormal function is generated by dividing in half coefficients of a first orthonormal function included in the plurality of orthonormal functions; and the second modified orthonormal function is generated by dividing in half coefficients of a second orthonormal function included in the plurality of orthonormal functions.

9. The electronic device according to claim 8, wherein the first driving means comprises:

dividing means for dividing in half the coefficients of the first orthonormal function to generate the first modified orthonormal function; and row drivers for driving the first plurality of rows with a set of voltages associated with the plurality of orthonormal functions, including the first modified orthonormal function, wherein the at least one display row, which is driven during both the first and second sets of time periods, is driven with a subset of voltages which is included in the set of voltages and associated with the first modified orthonormal function during the first set of time periods.

10. The electronic device according to claim 8, wherein the second driving means comprises:

dividing means for dividing in half the coefficients of the second orthonormal function to generate the second modified orthonormal function; and row drivers for driving the second plurality of rows with a set of voltages associated with the plurality of orthonormal functions, including the second modified orthonormal function, wherein the at least one display row, which is driven during both the first and second sets of time periods, is driven with a subset of voltages included in the set of voltages and associated with the second modified orthonormal function during the Second Set of time periods.

11. The electronic device according to claim 6, further comprising:

column drivers coupled to the transforming circuitry for driving the columns of the display with the first set of column voltages during the first set of time periods and for driving the columns of the display with the second set of column voltages during the second set of time periods.

12. The electronic device according to claim 11, wherein:

the electronic device is a radio communication device for receiving a radio frequency signal which includes the image data, the radio communication device including a decoder coupled to the receiver for recovering the image data from the radio frequency signal.

13. An electronic device comprising a display for presenting data, the display having columns and having at least first and second display segments comprising, respectively, first and second pluralities of rows, the electronic device comprising:

a receiver for receiving image data;

storing means for storing orthonormal functions;

dividing means coupled to the storing means for dividing in half coefficients of a first orthonormal function, thereby generating a first set of modified orthonormal functions, and for dividing in half coefficients of a second orthonormal function, thereby generating a second set of modified orthonormal functions;

row voltage generating means coupled to the dividing means for generating from the first set of modified orthonormal functions a first set of row voltages for driving the first display segment during a first set of time periods, and for generating from the second set of modified orthonormal functions a second set of row voltages for driving the second display segment during a second set of time periods, wherein:

at least one display row included in the second display segment is also included in the first display segment such that the at least one display row is driven during both the first and second sets of time periods; and transforming circuitry for transforming a first subset of the image data using the orthonormal functions to generate a first set of column voltages used to drive the columns during the first set of time periods, and for transforming a second subset of the image data using the orthonormal functions to generate a second set of column voltages used to drive the columns during the second set of time periods, wherein a portion of the image data that is included in both the first and second subsets thereof is transformed twice by the orthonormal functions.

14. The electronic device according to claim 13, wherein the storing means comprises a memory, and the dividing means comprises a controller.

15. The electronic device according to claim 13, further comprising row drivers including:

the row voltage generating means;

first row driving means coupled to the row voltage generating means for applying the first set of row voltages to the first display segment during the first set of time periods; and second row driving means coupled to the row voltage generating means for applying the second set of row voltages to the second display segment during the second set of time periods.

16. The electronic device according to claim 13, wherein:

the electronic device is a radio communication device which further comprises a decoder coupled to the receiver for recovering the image data from a radio frequency signal received by the radio communication device.

17. The electronic device according to claim 13, further comprising:

column drivers coupled to the transforming circuitry for driving the columns of the display with the first set of column voltages during the first set of time periods and for driving the columns of the display with the second set of column voltages during the second set of time periods.

* * * * *

UNITED STATES PATENT AND TRADEMARK OFFICE

CERTIFICATE OF CORRECTION

PATENT NO. : 5,475,397

DATED : December 12, 1995

INVENTOR(S) : Ali Saidi

It is certified that error appears in the above-indentified patent and that said Letters Patent is hereby corrected as shown below:

Claim 2, Column 13, Line 39, delete "fast" and insert --first--.

Claim 6, Column 14, Line 29, after function insert --,--.

Claim 10, Column 15, Line 22, delete "Second" and insert --second--.

Claim 10, Column 15, Line 23, delete "Set" and insert --set--.

Signed and Sealed this

Eleventh Day of June, 1996

*Attest:*

Bruce Lehman

BRUCE LEHMAN

*Attesting Officer*

*Commissioner of Patents and Trademarks*